United States Patent [19]

Flanagan et al.

[11] Patent Number: 4,854,768

[45] Date of Patent: Aug. 8, 1989

[54] DEPRESSIBLE ROADWAY MARKER

[75] Inventors: Robert M. Flanagan, Lincolnshire; Sidney A. Heenan, Park Ridge, both of Ill.

[73] Assignee: Amerace Corporation, Parsippany, N.J.

[21] Appl. No.: 58,037

[22] Filed: Jun. 4, 1987

Related U.S. Application Data

[63] Continuation-in-part of Ser. No. 778,491, Sep. 20, 1985, abandoned, which is a continuation-in-part of Ser. No. 728,835, Apr. 30, 1985, abandoned.

[51] Int. Cl.[4] ..... E01F 9/06

[52] U.S. Cl. ..... 404/11; 404/15

[58] Field of Search ..... 404/9, 10, 11, 15, 16; 350/103, 107

[56] References Cited

U.S. PATENT DOCUMENTS

| | | | |
|---|---|---|---|
| 2,703,038 | 3/1955 | Shaw | 404/16 |
| 3,693,511 | 9/1972 | Medynski | 404/16 X |
| 4,111,581 | 9/1978 | Auriemma | 404/10 |
| 4,232,979 | 11/1980 | Johnson, Jr. et al. | 404/16 |
| 4,504,169 | 3/1985 | Jones | 404/11 |
| 4,659,248 | 4/1987 | Flanagan | 404/10 |

FOREIGN PATENT DOCUMENTS

| | | | |
|---|---|---|---|
| 2434064 | 1/1976 | Fed. Rep. of Germany | 404/16 |

*Primary Examiner*—Jerome W. Massie, IV
*Assistant Examiner*—Matthew Smith
*Attorney, Agent, or Firm*—David Teschner

[57] ABSTRACT

A depressible roadway marker has an outer metal housing within which an elastomeric core is held. The core holds a retroreflective lens element above the level of the roadway which depresses into the metal housing when run over by a vehicle tire. The core includes a wiping element to scrub the lens element each time the core is depressed. The core includes structure to absorb the forces encountered during depression to reduce fatigue damage to the core.

17 Claims, 4 Drawing Sheets

DEPRESSIBLE ROADWAY MARKER

The present invention relates to an improvement in pavement markers and, more particularly, to an improvement in the type of marker frequently used in Great Britain and referred to as traffic or road studs, or cat's eye markers. This is an improvement of the invention described and claimed in copending British application Ser. No. 83/25528, filed Sept. 23, 1983, and is a continuation-in-part of copending U.S. application Ser. No. 778,491, filed Sept. 20, 1985, which is a continuation-in-part of U.S. application Ser. No. 06/728,835, filed Apr. 30, 1985, and now abandoned.

BACKGROUND OF THE INVENTION

Cat's eye markers generally consist of a metal casting disposed in a pocket cut into the road surface, in which is positioned a core of a resilient material such as a white or brightly colored elastomeric or rubber composition, supported entirely or partially within the rectangular or otherwise shaped cavity of the metal casting. The core generally is provided with two glass bead type reflectors which are intended to retro-reflect the headlights of approaching vehicles. The core is comprised generally of elastomeric or rubber material, such as natural rubber, and includes a portion which can wipe the front face of the glass lens as the upper marker body is depressed by the contact of a tire thereon. Lens members of the cube-corner type, if molded of glass, could be used but molded glass cube-corner reflectors do not have the accuracy or reflectivity of plastic cube-corner type reflectors and consequently for many years glass has not been used to make cube-corner type roadway or automotive reflectors. Plastics have supplanted glass for cube-corner reflectors for automotive and highway uses since the mid-40's. Plastic cube-corner type reflectors are advantageous over glass beads because they have a higher specific intensity than glass beads, they can be manufactured more economically and, most importantly they can be consistently molded to provide relatively uniform specific intensity, whereas glass beads vary widely in reflectance.

Such plastic is subject to abrasion. Its use as a lens element in the conventional rubber cat's eye core, where it is subjected to constant wiping action, results in wear of the front face, which degrades the reflectivity of the marker to a point where it would no longer be effective. While it has been ascertained that positioning a plastic reflector element at an appropriate angle will effect a balancing combination of wiping and abrasion, such angular construction cannot conveniently be used in existing cat's eye castings because the wiping action could no longer be accomplished either by a tire or by a single wiping element in the core.

It has been found advantageous to provide an abrasion-resistant surface to cover the plastic reflector to minimize abrasion.

It has also been found advantageous to provide the reflector with a radiused lower surface to minimize the abrasion that can occur when a rectangular, relatively sharp edge is repeatedly rubbed or wiped against a neoprene wiper blade. Use of such a radiused surface avoids the "digging" effect that can occur should the upward and downward movement of the core be slightly off a true vertical axis.

It has also been found advantageous to reduce stress on the core by forming tension reduction channels in the core to enable the core to flex repeatedly without tearing, and by providing a lens element which is secured to a reduced portion of the core width.

It has also been found advantageous to form the wiping element in an arcuate or curved segment to provide better contact with the reflector face.

The present invention provides an improved reflector assembly combination of a replaceable elastomeric core and a plastic cube-corner type lens element with a flat abrasion resistant surface and an elongated wiper blade integral with the base portion. An extended surface area having substantial retroreflective benefits of the cube-corner type is thus provided while at the same time preserving the retroreflectivity of the lens element during use, while enhancing durability of the core.

It therefore is an object of the present invention to provide an improved road surface marker equipped with self-wiping retroreflective cube-corner type reflectors and to provide appropriate protection for the reflectors during the automatic cleaning of the same which takes place when the core element is depressed when traveled over by vehicles such as are met in ordinary road traffic.

SUMMARY OF THE INVENTION

The invention, in its preferred embodiment, comprises a reflector assembly for use in a metal casting to provide a road surface marker. The metal housing has a generally rectangular cavity with a horizontal base formed therein, front and rear walls adapted to be positioned perpendicular to the direction of traffic when the casting is secured to the roadway surface, and opposed side walls provided with pairs of integral attachment fingers extending into the cavity, said front, rear and side walls having upper edges extending above the associated road surface when the metal casting is fixedly installed thereon.

The reflector assembly comprises a resilient elastomeric core adapted to be removably positioned in the associated metal casting. The core includes a generally rectangular hollow base portion and an upper lens housing portion; the hollow base has a pair of oppositely disposed side walls, each having apertures therein adapted to receive therein the opposing pairs of fingers of the associated casting side walls when the core is positioned in the associated cavity. At least one of the front or rear walls of the hollow base is provided with an inwardly extending wiper blade extending substantially from one side wall to the other side wall.

The lens housing includes generally parallel front and rear walls to be juxtapositioned with the associated front and rear walls of the associated casting and includes opposed inwardly inclined side walls extending upwardly from the base portion side walls and joined to a generally flat upper wall positioned almost parallel to the top edges of the associated casting.

The lens housing has a lens retainer block formed integrally therewith, and each end of the front or rear walls of the lens retainer block is provided with a recess therein adapted to receive an elongated lens member. The lens member has a generally flat front face terminating at its lowermost edge in a radiused shoulder portion and is provided on the rear face thereof with a plurality of cube-corner type reflecting elements for reflecting light incident on the front face generally parallel and back to the source thereof. The lens member is formed of a synthetic organic resin and is provided with an outer light transmitting protective surface generally coextensive to the reflective area of the lens member, the outer surface being formed of a more abrasion resistant material than the lens member.

When the core is disposed in the associated casting, engagement of the lens marker by a vehicle tire will cause the lens housing to be depressed within the hollow area provided by the hollow base and into the cavity defined by the associated casting, and upon such movement the lens member and the associated abrasion resistant surface formed thereon will effect a wiping movement relative to the associated wiping blade formed on the base member. The lens housing then will return to the operable position thereof as the tire disengages the marker. Tension reduction channels are formed in each retainer block to enable the block to stretch and distend without peripheral tearing while the core is being depressed or is returning to its unstressed operative, or at-rest position. The lens member is preferably T-shaped, with a rearwardly-extending leg to fit within the lens retainer block recess. To further reduce wear caused by flexing of the core, said lens leg may be glued along only a central portion of the retainer block recess, leaving both ends of the lens leg unattached. Alternatively, the lens leg is reduced in size, and the lens recess is similarly reduced in size to match the leg.

The invention, both as to its organization and method of operation, together with other objects and advantages thereof, will best be understood with reference to the following specification, taken in combination with the accompanying drawings:

DETAILED DESCRIPTION OF THE DRAWINGS

Figure 1:
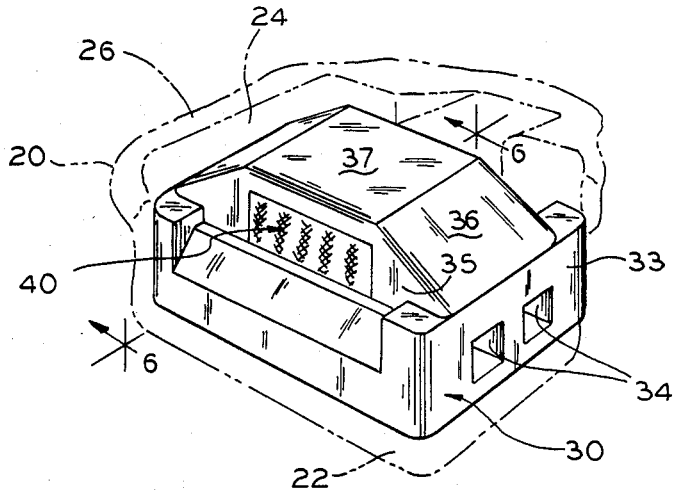
FIG. 1 is a perspective view of the reflector assembly of the present invention, with an associated metal casting shown partially in phantom.
Figure 2:
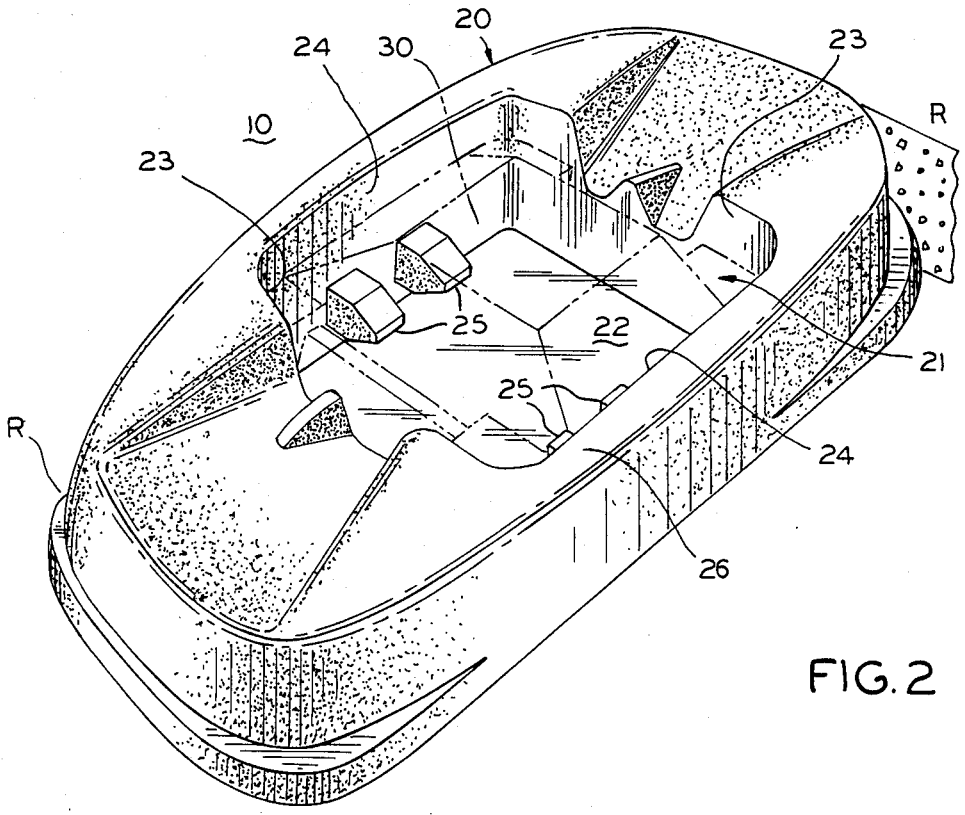
FIG. 2 is a perspective of the traditional casting used for the cat's eye marker, with the core of the present invention shown in phantom.

Referring now to the drawings, and more particularly to FIGS. 1 and 2 thereof, reference numeral 10 designates the road marker which has as its major components a metal casting 20 of the type generally used for the conventional road stud or cat's eye marker (which may be of the type similar for example to that shown in U.S. Pat. No. 2,703,038); in which is mounted a core member 30, preferably formed of Neoprene and which includes a reflective lens member 40 for providing a signal function.

Figure 6:
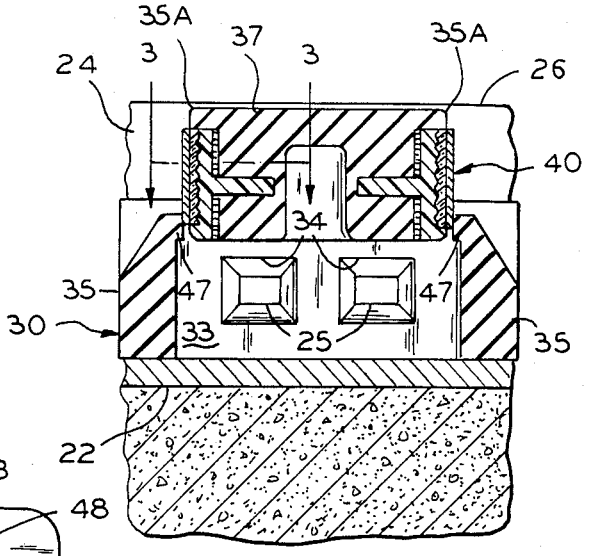
FIG. 6 is a sectional view of the unstressed reflector assembly taken in the direction of the arrows 6—6 in FIG. 1, and illustrates the assembly in the normal operative position.

Metal casting 20 has a generally rectangular cavity 21 formed therein with a horizontal base 22. The metal casting 20 has parallel front and rear walls designated generally as 23, intended to be disposed generally perpendicular to the direction of traffic flow when the casting is secured to the roadway surface designated "R" in FIG. 2. The casting 20 also is provided with opposed parallel side walls 24. Each of the side walls 24 is provided with pairs of integral attachment fingers 25 extending into the cavity defined by the bottom, side and front and rear walls. For illustration purposes, a pair of attachment fingers 25 is shown in FIG. 6. The front, rear and side walls terminate in upper edges 26 intended to be disposed above the associated roadway surface when the metal casting is fixedly installed therein, and provide an enclosure to provide some protection against snow plow blades and the like.

Figure 4:
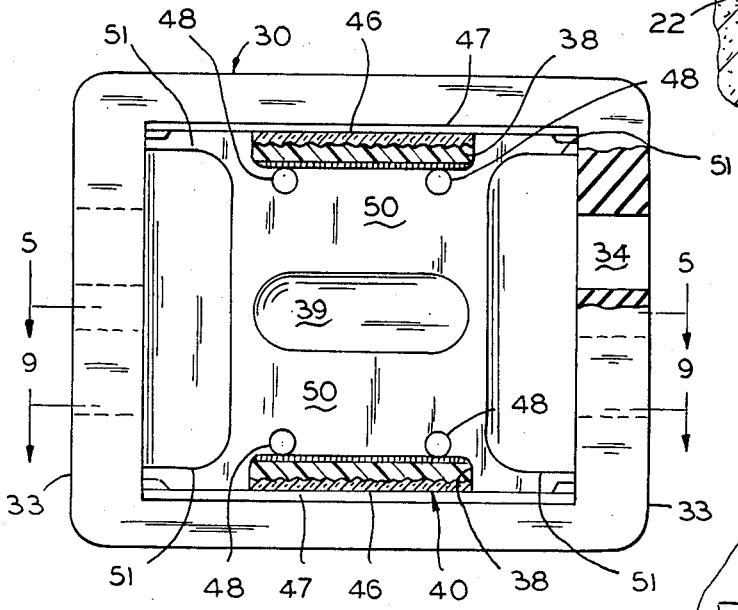
FIG. 4 is a bottom plan view of the reflector assembly showing the placement of the tension reduction channels.
Figure 5:
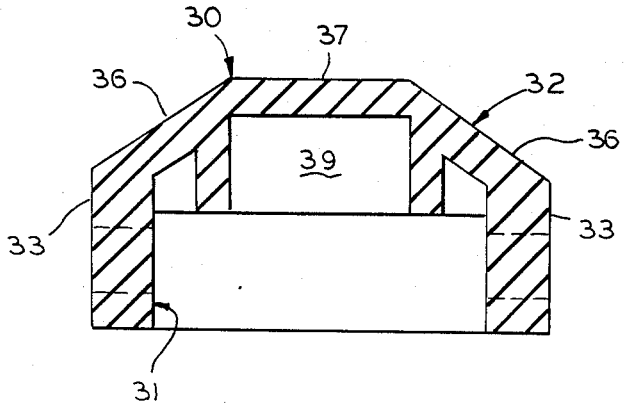
FIG. 5 is a sectional view of the reflector assembly taken in the direction of the arrows 5—5 in FIG. 4.

Referring now to FIGS. 4 and 5, the improved reflector assembly of the present invention which is intended to be disposed within the otherwise conventional metal casting 20, comprises a resilient elastomeric core 30 adapted to be removeably positioned in the associated casting 20. The core 30 includes a generally rectangular hollow base portion 31 and an upper lens housing portion 32. The entire core 30 is injection molded in a conventional and well-known fashion. The hollow base 31 has a pair of oppositely disposed side walls 33, each having apertures 34 formed therein at the time of molding the core 30, which apertures 34 are adapted to receive therethrough the opposing pairs of attachment fingers 25 of the associated casting side walls when the core 30 is positioned in the metal casting.

Figure 7:
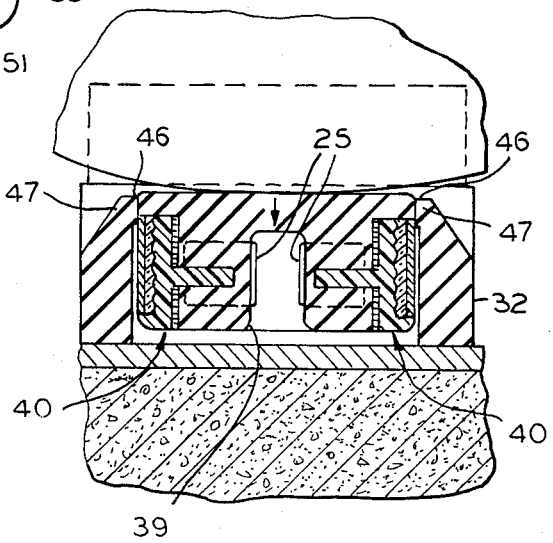
FIG. 7 is a view similar to view FIG. 6, but illustrating the lens housing portion of the core member in the depressed condition under the action of a vehicle tire.

The lens housing 32 includes generally parallel front and rear walls 35A intended to be parallel to the associated front and rear walls 23 of casting 20. The lens housing 32 also includes opposed inwardly inclined side walls 36, extending inwardly and upwardly from the base portion side walls 33 and integrally joined to a generally flat upper or top wall 37. The lens housing 32 further is provided with a lens retainer block 50 having a generally rectangular notch defining a lens holding "T" shaped pocket 38 on at least one (or both as shown) of the front or rear faces thereof, and also is provided with an internal cavity 39 in the top wall 37, permitting flexing of the lens housing during depression under a vehicle tire as illustrated in FIG. 7.

Figure 3:
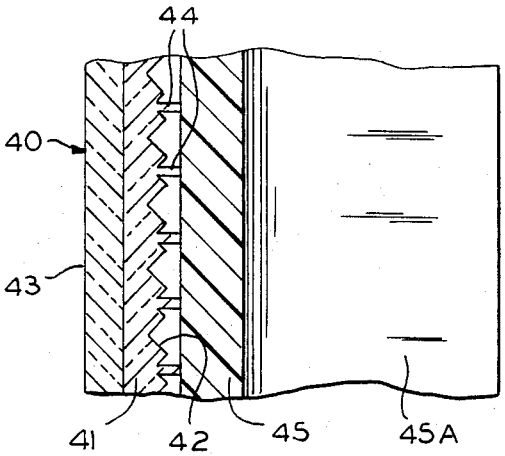
FIG. 3 is an enlarged partial sectional view of the lens assembly of the present invention, taken along lines 3—3 in FIG. 6.

The lens pocket 38 (FIG. 4) is intended to receive an improved composite lens member 40 (FIG. 3) which provides the retroreflective function of the roadway marker. In the present instance, the lens member 40 consists of a reflector portion 41 which has a generally flat front face and is provided on the reverse face with a plurality of reflector elements 42 thereon of the cube-corner type.

While no specific arrangement of cube-corner elements has been illustrated in the drawings, it will be understood that for purposes of this application a cube-corner type reflector (also known as trihedral or triple mirror reflector) consists of three mutually perpendicular faces intended to retroreflect light in a direction generally parallel to the light incident upon the front face of the lens element. The three faces need not be of equal size or equal shape and may include rectangles, triangles, squares, etc. It is also known in the art that cube-corner type reflectors may be designed so that their optical axes are aligned with the nominal incident ray for optimum reflectivity under certain lighting conditions.

The lens 41 generally is formed of a light transmitting synthetic organic resin such as polymethylmethacrylate or polycarbonate. Polycarbonate is preferred because of its impact strength. Normally polycarbonate would not be used because of its susceptibility to abrasion compared with polymethylmethacrylate and its deterioration under ultraviolet light, but the protective outer surface of the present invention serves the double function of protecting against abrasion and of filtering out the effects of ultraviolet light. As part of the invention, the lens member 40 is provided with a light transmitting protective outer surface 43 generally coextensive to the reflector area of the lens member 40, the outer surface 43 being formed of a more abrasion resistant material than the lens member. One such satisfactory material is glass having a thickness of about 6 mils. Such glass may be applied in a fashion such as disclosed in assignee's U.S. Pat. No. 4,232,979.

The lens 41 further is provided with a series of parallel, rearwardly extending dividing and peripheral walls 44, which are in turn hermetically secured to a rigid backing plastic member 45. The rear member 45 preferably is "T" shaped such that it has a rearwardly extending leg 45A to facilitate mounting in the "T" shaped pocket 38 of the lens housing portion 32. The reflector lens member 40 may be adhered within the lens pocket 38 by use of an appropriate adhesive whereby the lens member is fixedly secured to the elastomeric core 30. Finally, each of the front and rear walls 35 of the core 30 is provided with a slit or cut line 46 therein which extends substantially between the side walls 33 and separates the upper lens housing portion 32 from the base portion 31. The slit is provided in such a fashion so as to leave an inwardly extending lip which forms a wiper blade 47 thereon (FIG. 6). The slit also permits downward movement of the upper lens housing portion 32 past the blade 47 and into the hollow base portion 31.

As illustrated in FIGS. 6 and 7, upon placement of the core 30 into the associated metal casting 20, the upper edge 26 of the casting and the top wall 37 will be disposed approximately ¾" above the road surface. Top wall 37 may also be disposed level with the roadway surface. As a vehicle tire rolls over the upper body portion 32 and top wall 37, it will cause wall 37 to flex and to be depressed into the hollow area provided by the base member 31 and into the cavity defined by the associated casting. When top wall 37 is level with the roadway surface, core 30 will be depressed by the tendency of said vehicle tire to "sag" into metal casting 20. Upon such movement, the lens member 40, and particularly abrasion resistant surface 43, will be moved past the wiper blade 47 contained on the lower body portion 31 of core 30. Such movement will effect a debris cleaning and wiping function on the front abrasion resistant surface 43 of the lens member, thereby maintaining the lens member clean and keeping it in an efficient condition.

Figure 8:
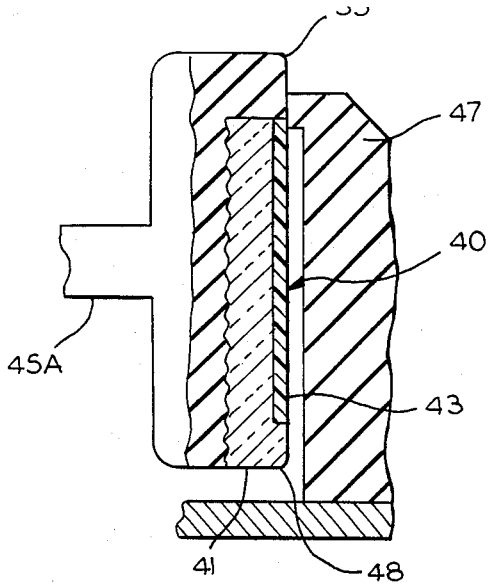
FIG. 8 is a detail of the circled portion C of FIG. 7, illustrating the radiused lower edge of the reflector lens.
Figure 9:
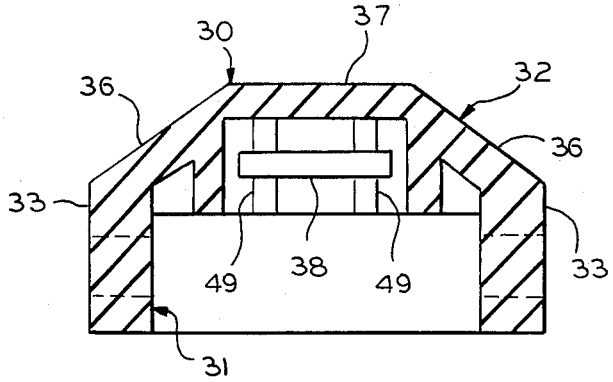
FIG. 9 is a view along 9—9 of FIG. 4, showing the tension reduction channels.

As seen in FIG. 8, lens member 40 is formed with a radiused edge 48 thereon to reduce the drag and resultant wear on wiper blade 47, to improve the efficient wiping action of wiper blade 47 and to blunt the lower, sharp edges of lens 41.. Shielding the lower edge alleviates chipping of surface 43 and gouging of the inner surface of wall 35. Where lens 41 is completely overlapped by protective surface 43, the lowermost edge of surface 43 will similarly be radiused. A preferred radius is 0.12 inch.

Providing cavities 39, 53 and 54 in core 30 permits substantial flexing of the upper lens housing portion 32 and provides substantial support area behind the lens member 40 to prevent deleterious stress which could cause cracking or breakage thereof. Adding tension reduction channels 49 to lens retainer block 50 (as seen in FIGS. 9, 10, 11, 13 and 14) adds further tension reduction capability. In the embodiment herein shown, tension reduction channels 49 are generally perpendicular to, and communicate with lens pocket 38 of block 50, and open onto cavity 60 of core 30. Lens pocket 38 is intended to receive leg 45A of reflector 40.

Figure 10:
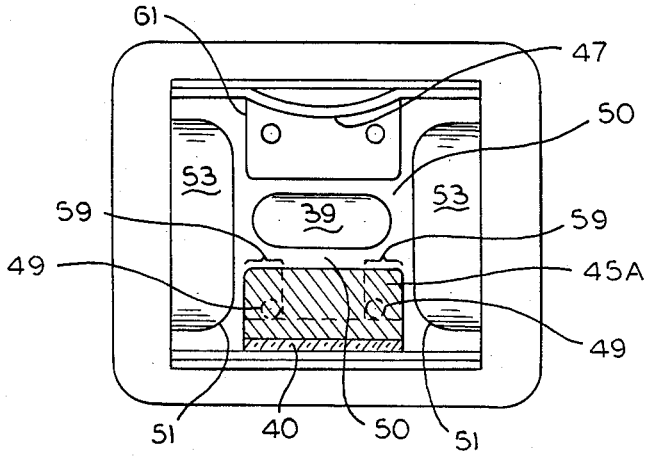
FIG. 10 shows the tension reduction channels of FIG. 9 when the core is in its operative unstressed position, with one reflector removed to show the curved, unstressed core wiper.
Figure 11:
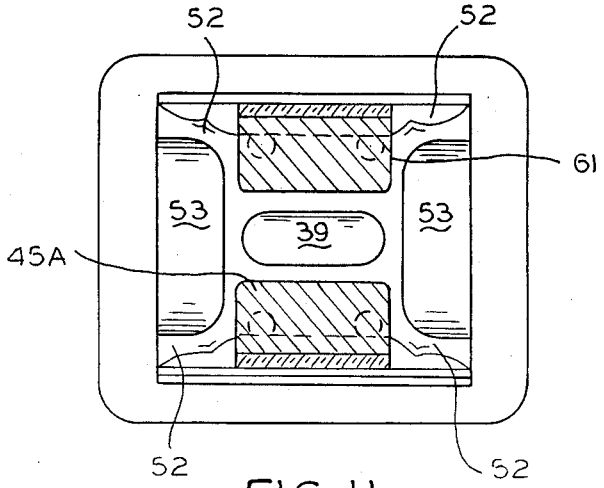
FIG. 11 shows the tension reduction channels when the core is stressed.

In the embodiment shown in FIGS. 10 and 11, tension reduction channels 49 are fully overlapped and interrupted by leg 45A. In the embodiment shown in FIGS. 13 and 14, tension reduction channels 49 overlap leg 56 only partially. A preferred size for tension reduction channels 49 is 0.180 inch in diameter. In the embodiment shown in FIGS. 12 and 13, channels are positioned 1.18 inches apart as measured form outside diameter to outside diameter, while leg 56, centered between channels 49, is 1.13 inches in width. As lens housing 32 is depressed (as seen in FIG. 7), elastomeric core 30 flexes, and tension reduction channels 49 allow core 30 to distort more freely in a horizontal direction than if core 30 were formed without channels 49. In this manner, the life of core 30 is extended by reducing the fatigue associated with repeated twisting, compression, stretching and flexing of elastomeric castings.

It is to be understood that channels 49 may be placed throughout core 30, where desired, to provide protection against material fatigue. Also, it may be appropriate to form the wiper blade 47 so that it is curved inwardly in the center thereof, thereby to assure uniform pressure on the lens member 40, as shown in FIG. 10.

Traditionally the cat's eye marker has used two glass beads each having a diameter of about 0.43". Under the present system, a single lens member 40 is used; it has a dimension of approximately ¾" high by 1¾" wide and it will provide specific intensity at 0.2° observation angle and 0° entrance angle of approximately five times the specific intensity of the typical cat's eye. One would have to use at least five glass bead elements in a similar sized core to obtain the same reflectivity. Using more than two beads is not practical however, for a number of reasons: it would weaken the core element by having the additional lens elements therein; also, there would be incomplete wiping caused by the serrated type wiping surface which would be required. Finally, there is not enough area on the housing to accommodate more than two glass beads in their metal cans. It has also been observed that the metal prongs which hold the metal cans in the cat's eye assembly may become exposed as the assembly is worn, weakening the assembly, and possibly exposing sharp points to tires, a result which the present invention avoids.

The elastomeric body 30 of the present invention is preferably formed of neoprene having a hardness in the range of 48 to 60 durometer, Shore A. In addition, a preferred blend of neoprene will also include a lubricant or combination of lubricants to further reduce friction and wear upon lens member 40. A lubricating system that has been successfully employed comprises Silane A-189, petrolatum, wax petrolatum, and a blend including 20% Silane A-189, 40% petrolatum, and 40% wax petrolatum. This system is present in a proportion of about 2% by weight of the resulting neoprene elastomer, and will extend the useful life of the core as compared to a core formed of unmodified neoprene or natural rubber; yet it is soft and flexible enough to deform and provide the necessary wiping action. Neoprene also has characteristics of not "breaking down" to leave residue on the reflector.

As seen in FIGS. 10 and 11, core 30 is distorted when depressed, and tension reduction channels 49 allow core 30 to absorb the potentially destructive stress forces by allowing core 30 to stretch at critical stress points to a greater degree than if core 30 were formed without channels 49. This reduces the stress concentration to which the core is subjected, by allowing core 30 to distort as core segments 52 are stretched during depression of core 30. During compression of said upper member body, said sections are both deflected and elongated to reduce the tension therein. In this context, the term "stretch" indicates the distribution of forces along core segments 52, with said core segments having relatively narrowed cross-section configuration, and the elongation of said core segments to absorb said forces. Also, adding to the capacity of core 30 to absorb such forces is the rounding of the internal surfaces of core 30, such as shown at 51 of FIG. 4.

Further reduction of stress has been found to occur when adhesive is applied only to the top and bottom surfaces of the central portion of leg 45A, as shown at 59 of FIG. 10, leaving the portions proximate ends 45B and the edges of leg 45A free of adhesive. In this manner, those portions of core 30 proximate the adhesive-free portions of lens pocket 38 are free to stretch and thus relieve tensile stress.

Figure 12:
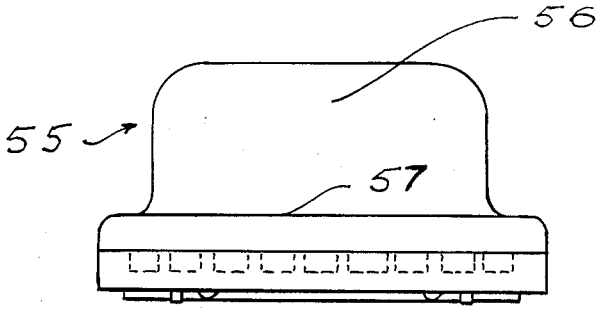
FIG. 12 is a top elevational view of a second embodiment of the lens element.
Figure 13:
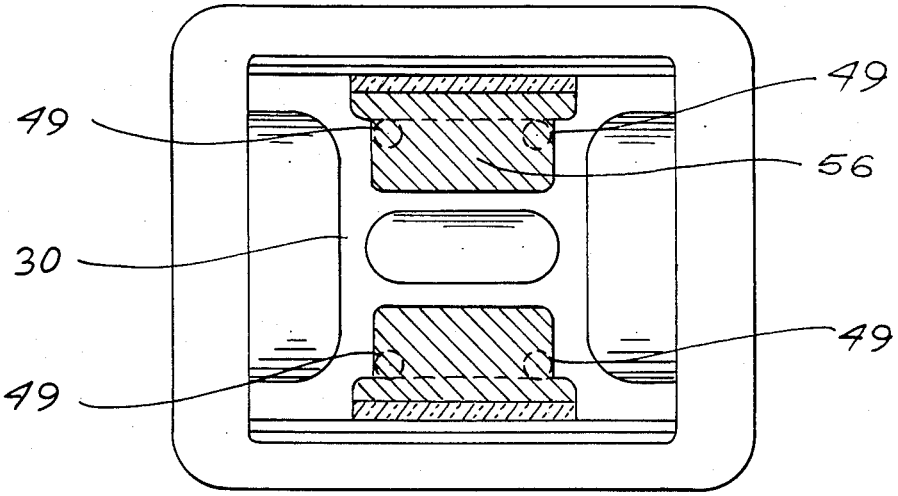
FIG. 13 shows the lens element of FIG. 12 and the tension reduction channels of FIG. 9 when the core is in its operative unstressed portion.
Figure 14:
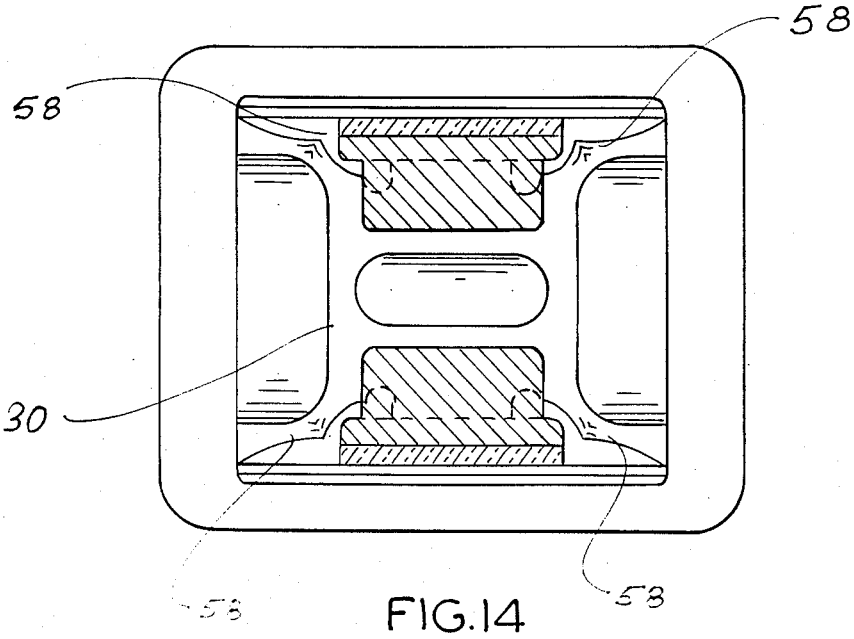
FIG. 14 shows the lens element of FIG. 12 and the tension reduction channels of FIG. 9 when the core is stressed.

Such stress reduction may also be accomplished as illustrated by the embodiment shown in FIGS. 12, 13 and 14. In FIG. 12, lens element 55 has a leg 56 which is narrowed, that is, which extends across only a reduced central portion of lens holder rear face 57.

As seen in FIGS. 13 and 14, core 30 has lens pocket 61 made smaller to fit narrowed leg 56, and, preferably, adhesive is applied to only the top and bottom surfaces of leg 56, leaving the edges thereof devoid of adhesive. FIG. 14, showing core 30 in the depressed or stressed attitude, illustrates the increased area 58 of core 30 available to stretch and absorb a portion of the stress created by compression of core 30.

The above detailed description is provided by way of example only, and is not intended to limit the scope of the invention. Various details of the design and construction may be modified without departing from the true spirit and scope of the invention as defined in the appended claims.

What is claimed is:

1. A reflector assembly for use in an associated metal housing to provide a road surface marker, the associated metal housing having a generally rectangular cavity with a horizontal base formed therein, front and rear walls structured and dimensioned to the positioned perpendicular to the direction of traffic when said metal housing is secured to the road surface, and opposed side walls provided with integral attachment fingers extending into the cavity, said reflector assembly comprising:

a resilient elastomeric core structured and dimensioned to be removably positioned in said metal housing and to extend in a normal operative position above said metal housing, said core being formed of Neoprene which includes a lubricant therewithin, said core including a hollow base portion of generally rectangular cross-section, and an upper lens housing portion, said hollow base portion having a front wall, a rear wall, and a pair of oppositely disposed side walls, each said side wall having apertures therein structured and dimensioned to register with and receive said opposing pairs of attachment fingers of said metal housing side walls when said core is positioned in said metal housing cavity;

said lens housing portion including generally parallel front and rear walls parallel to said front and rear walls of said metal housing and including opposed inwardly inclined side walls extending upwardly from said base side walls and joined to a generally flat upper wall, at least one of said front or rear walls of said wall portion being provided with an inwardly extending wiper blade extending substantially from one side wall to the other side wall;

a lens retainer block integral with said lens housing portion, said retainer block having a recess therein structured and dimensioned to receive an elongated lens member, said lens member having a generally flat front face terminating in a radiused lowermost edge and being provided on the rear face thereof with a plurality of cube-corner type reflecting elements for reflecting light incident on said front face generally parallel and back to the source thereof, said lens member being formed of a synthetic organic resin and further being provided with an outer light transmitting protective surface generally coextensive with the reflective area of said lens member, said outer surface being formed of a more abrasion resistant material than said lens member, whereby upon placement of said core in the associated metal housing, engagement of said upper lens housing portion by a vehicle tire will cause said upper body portion to be forced through a range of movement into said hollow are provided by said base member and into the cavity defined by said associated housing, said lens member and the associated abrasive resistant surface thereon effecting a wiping and debris cleaning movement against said wiping blade formed on said base member during said movement, said lens housing portion resiliently returning to said normal operative position thereof when disengaged by said vehicle tire.

2. The reflector assembly set forth in claim 1, wherein said protective surface face of said lens member is glass.

3. The reflector assembly set forth in claim 1, wherein one said wiper blade is positioned approximately at the plane of the associated roadway surface and adjacent to the front face of said lens member.

4. The reflector assembly set forth in claim 1, and further including means for fixedly securing said lens member to said upper lens housing portion.

5. The reflector assembly set forth in claim 1, wherein said lens member includes a "T" shaped section adhered to the lens member and having a leg of the "T" embedded in an accompanying groove provided in the upper lens housing portion.

6. The reflector assembly set forth in claim 1, wherein said wiper blade is configured such that the central portion between said side walls is curved inwardly toward said lens member thereby to assure uniform pressure on said lens member during wiping movement thereof past said wiper blade.

7. The reflector assembly set forth in claim 1, wherein said cube-corner type lens member includes a rearwardly extending peripheral wall and a plurality of rearwardly extending dividing walls separating areas of said cube-corner elements into discrete cellular sections, and a rigid backing member secured to said walls thereby to hermetically seal the same.

8. A reflector assembly for use in an associated metal housing to provide a road surface marker, the associated metal housing having a generally rectangular cavity with a horizontal base formed therein, front and rear walls structured and dimensioned to be positioned perpendicular to the direction of traffic when said metal housing is secured to the roadway surface, and opposed side walls provided with integral attachment fingers extending into the cavity, said front, rear and side wall having upper edges intended to be above the associated road surface when the metal housing is fixedly installed thereon, said reflector assembly comprising, a resilient elastomeric core structured and dimensioned to be removably positioned in said metal housing and to extend, in a normal operative position, above said metal housing;

said core including a hollow base portion of generally rectangular cross-section, and an upper lens housing portion, said hollow base portion having a front wall, a rear wall, and a pair of oppositely disposed side walls, each said sidewall having apertures therein structured and dimensioned to register with and receive said opposing pairs of attachment fingers of said metal housing side walls when said core is positioned in said metal housing cavity, said lens housing portion including generally parallel front and rear walls parallel to said front and rear walls of said metal housing and including opposed inwardly inclined side walls extending upwardly from said base side walls and joined to a generally flat upper wall, at least one of said front or rear walls of said base portion being provided with an inwardly extending wiper blade extending substantially from one side wall to the other side wall;

a lens retainer block integral with said lens housing portion, said retainer block having a recess therein structured and dimensioned to receive an elongated lens member therein;

said lens member having opposite ends and an upper and lower edge, with said lower edge being radiused;

said lens member having a generally flat rear face and a leg extending along said rear face between said opposite ends, said lens member having a generally flat front surface and being provided with a plurality of cube-corner type reflecting elements as the rear surface of said front face for reflecting light incident on said front face generally parallel and back to the source thereof, said lens member being formed of a synthetic organic resin and further being provided with an outer light transmitting protective surface generally coextensive to the reflective area of said lens member, said outer surface being formed of a more abrasion resistant material than said lens member, whereby upon placement of said core in the associated metal housing, engagement of said upper lens housing portion by a vehicle tire will cause said upper body portion to be forced through a range of movement into and thereafter out of said hollow area provided by said base member and into the cavity defined by said associated casting, said lens member and the associated abrasive resistant surface thereon effecting a wiping and debris cleaning movement against said wiping blade formed on said base member during said movement, said lens housing portion resiliently returning to said normal operative position thereof;

said elastomeric core including means for reducing the tension generated within said core when said core is forced through said range of movement, said tension reduction means including at least one channel formed within said upper lens housing portion.

9. The reflector assembly of claim 8, wherein at least one said channel extends vertically within said upper lens housing portion.

10. The reflector assembly of claim 8, wherein at least one said channel is positioned proximate one said lens member.

11. The reflector assembly of claim 8, wherein at least one said channel is positioned within said lens retaining block.

12. The reflector assembly of claim 11, wherein each said channel extends generally vertically.

13. The reflector assembly of claim 8 wherein said tension reduction means includes at least two vertically extending channels formed within said upper lens housing portion and positioned proximate said opposite ends of said lens member.

14. The reflector assembly of claim 8 wherein said tension reduction means includes forming said lens leg centrally on said rear lens face and terminating said lens leg short of said lens member ends.

15. The reflector assembly of claim 8 wherein said tension reducing means includes means for securing said lens leg to said core in said recess, said securing means being applied to a central portion of said lens leg, said central portion being less in length than said lens leg, the remaining portion of said lens leg being positioned in said recess.

16. The reflector assembly of claim 15 wherein said securing means is an adhesive.

17. A reflector assembly for use in an associated rigid housing to provide a road surface marker, the associated rigid housing having a horizontal base with sidewalls extending above said base to define therewithin a cavity, said reflector assembly comprising:

a resilient elastomeric core structured and dimensioned to be positioned in said cavity and to extend, in a normal operative position, above said rigid housing, said core being formed of Neoprene which includes a lubricant therewithin, means to retain said core in said housing;

said core including an upper lens housing portion;

a lens retainer block integral with said upper lens housing portion;

a lens member having a plurality of reflecting elements for reflecting light incident on said lens member generally parallel and back to the source thereof, said lens retainer block including means for securing said lens member to said block, whereby engagement of said upper lens housing portion by a vehicle tire will cause said upper lens housing portion to be forced through a range of movement into said cavity defined by said housing.

said core structured and dimensioned to cause said upper lens housing portion to resiliently return to said normal operative position thereof when disengaged by said vehicle tire.

* * * * *

UNITED STATES PATENT AND TRADEMARK OFFICE

CERTIFICATE OF CORRECTION

PATENT NO. : 4,854,768

DATED : August 8, 1989

INVENTOR(S) : Robert M. Flanagan et al.

It is certified that error appears in the above—identified patent and that said Letters Patent is hereby corrected as shown below:

In the claims:

Col. 8, line 31, delete the word "wall" and insert --base--.

Col. 8, line 55, delete the word "are" and insert --area--.

Signed and Sealed this

Thirty-first Day of July, 1990

*Attest:*

HARRY F. MANBECK, JR.

*Attesting Officer*

*Commissioner of Patents and Trademarks*